United States Patent [19]

Meistrick

[11] Patent Number: 4,996,957

[45] Date of Patent: Mar. 5, 1991

[54] CONTROL VALVE FOR A COMPRESSION RELEASE ENGINE RETARDER

[75] Inventor: Zdenek S. Meistrick, Bloomfield, Conn.

[73] Assignee: Jacobs Brake Technology Corporation, Wilmington, Del.

[21] Appl. No.: 532,964

[22] Filed: Jun. 4, 1990

[51] Int. Cl.[5] ..... F02D 13/04

[52] U.S. Cl. ..... 123/321

[58] Field of Search ..... 123/90.16, 90.22, 90.12, 123/315, 321, 345, 347

[56] References Cited

U.S. PATENT DOCUMENTS

| | | | |
|---|---|---|---|
| 3,220,392 | 11/1965 | Cummins | 123/321 |
| 3,405,699 | 10/1968 | Laas | 123/320 |
| 4,271,796 | 6/1981 | Sickler et al. | 123/321 |
| 4,398,510 | 8/1983 | Custer | 123/90.16 |
| 4,399,787 | 8/1983 | Cavanagh | 123/321 |
| 4,473,047 | 9/1984 | Jakuba et al. | 123/323 |
| 4,655,178 | 4/1987 | Meneely | 123/321 |
| 4,664,070 | 5/1987 | Meistrick et al. | 123/321 X |
| 4,706,625 | 11/1987 | Meistrick et al. | 123/321 |
| 4,711,210 | 12/1987 | Reichenbach | 123/321 |

*Primary Examiner*—Willis R. Wolfe

[57] ABSTRACT

An improved control valve for use in a compression release engine retarder is disclosed. The control valve for the high pressure hydraulic fluid circuit of the retarder is arranged in series with a check valve so that the pressure drop in the circuit is taken principally across the check valve and the control valve is exposed only to the pressure of the low pressure hydraulic fluid supply system. In accordance with another feature of the invention, the control valve is provided with a relief port which is opened in response to excess pressure in the low pressure hydraulic fluid supply to limit the quantity of hydraulic fluid introduced into the high pressure circuit and thereby prevent excess motion or "jacking" of the slave piston and its associated exhaust valve.

8 Claims, 10 Drawing Sheets

TDC I
TDC II
MOTION
CRANK ANGLE DEGREES
0
180
360
540
720,0

CONTROL VALVE FOR A COMPRESSION RELEASE ENGINE RETARDER

BACKGROUND OF THE INVENTION

1. Field of the Invention

The present invention relates to engine retarders of the compression release type. More particularly it relates to an improved control valve for a compression release engine retarder.

2. The Prior Art

Engine retarders of the compression release type are well known in the art. In general, such retarders are designed temporarily to convert an internal combustion engine into an air compressor so as to develop a retarding horsepower which may be a substantial portion of the operating horsepower normally developed by the engine in its powering mode.

The basic design for an engine retarding system of the type here involved is disclosed in the Cummins U.S. Pat. No. 3,220,392. In that design an hydraulic system is employed wherein the motion of a master piston actuated by an appropriate intake, exhaust or fuel injector pushtube or rocker arm controls the motion of a slave piston which opens the exhaust valve of the internal combustion engine near the end of the compression stroke whereby the work done in compressing the intake air is not recovered during the expansion or "power" stroke but, instead, is dissipated through the exhaust and cooling systems of the engine.

Various improvements have been made in the original design shown in the Cummins U.S. Pat. No. 3,220,392. Laas U.S. Pat. No. 3,405,699 discloses a device to unload the hydraulic system whenever excess motion of the slave piston tends to open the exhaust valve too far and hence risk damage to the components of the engine.

Sickler et al. U.S. Pat. No. 4,271,796 discloses a pressure relief system for a compression release engine retarder wherein a bi-stable ball relief valve and a damping mechanism rapidly drops the pressure in the hydraulic system to a predetermined low level whenever an excess pressure is sensed in the hydraulic system thereby obviating the risk of damage to various components in the engine valve train mechanism.

Custer U.S. Pat. No. 4,398,510 discloses an improved timing mechanism for an engine retarder which produces an increased retarding horsepower while increasing the time span between the beginning of the engine retarding action and the beginning of the normal opening of the exhaust valves of the engine.

Jakuba et al. U.S. Pat. No. 4,473,047 discloses a compression release engine retarder for an engine having dual exhaust valves wherein, during the retarding mode, only one of the dual exhaust valves is opened while in the powering mode both valves are opened.

Cavanagh U.S. Pat. No. 4,399,787 discloses an hydraulic reset mechanism particularly applicable to engine retarders of the type described in U.S. Pat. No. 4,473,047 wherein the exhaust valve opened during retarding is closed promptly after the retarding event has been completed and well before the normal opening of the dual exhaust valves begins thereby avoiding damage due to unbalanced or stress loading of the exhaust valve crosshead.

Despite the various improvements which have been made in the compression release retarder, including those noted above, certain problems still exist. During the retarding mode of operation high levels of pressure are experienced in the retarder hydraulic system. These high pressures act on the master piston, slave piston and control valve and result in leakage of oil past these elements. In order to reduce such leakage to an acceptable level, close tolerances must be maintained for each of these elements. It will be appreciated that if the control valve could be isolated from the high pressure hydraulic circuit, its manufacturing costs could be reduced substantially, its reliability improved, and the leakage of high pressure oil virtually eliminated. The elimination of such leakage would increase the retarding horsepower, render the retarding performance more consistent for each engine cylinder, and decrease the variation in performance among production models of engine retarders. Finally, the control valve would become less sensitive to contaminants in the engine oil supply used to operate the retarder. The present invention is directed to these objectives.

SUMMARY OF THE INVENTION

In accordance with the present invention applicant has provided an improved control valve for use in controlling the high pressure hydraulic circuit of a compression release engine retarder. The improved control valve is arranged in series with a check valve so that the pressure drop in the circuit is taken principally across the check valve while the pressure drop across the control valve is relatively minor. The control valve also incorporates a relief port which prevents "jacking" of the exhaust valves due to excessively high engine oil pressure.

BRIEF DESCRIPTION OF THE DRAWINGS

Additional advantages of the apparatus in accordance with the present invention will become apparent from the following detailed description of the invention and the accompanying drawings in which:

FIG. 1B is a schematic diagram of the apparatus of FIG. 1A showing the position of the parts when the retarder has been turned on;

FIG. 2B is a schematic diagram of the apparatus of FIG. 2A showing the position of the parts when the retarder has been turned on;

DETAILED DESCRIPTION OF THE INVENTION

Figure 1A:
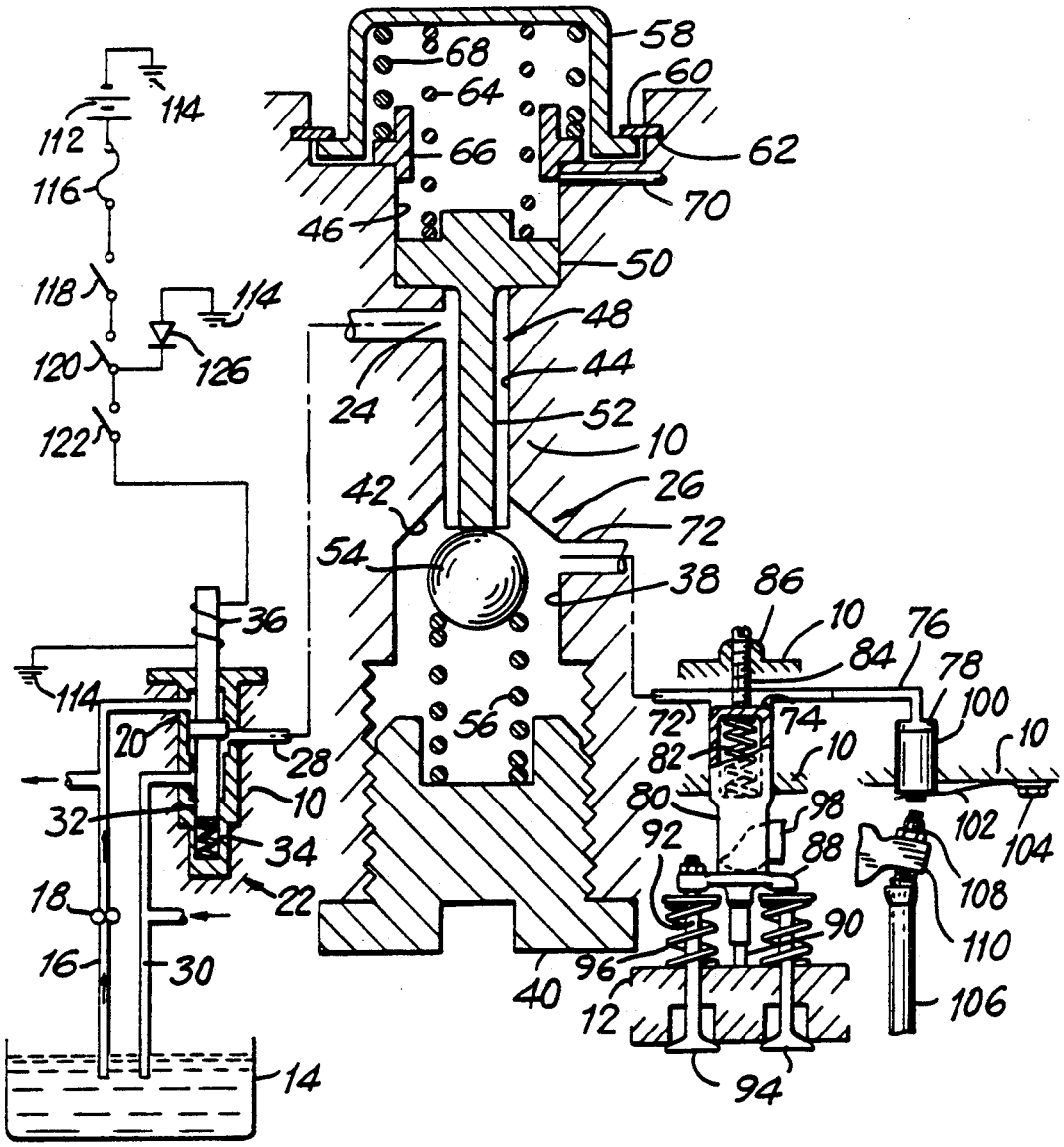
FIG. 1A is a schematic diagram of a compression release engine retarder incorporating an improved control valve in accordance with the present invention, showing the position of the parts when the retarder is turned off.

FIG. 1A is a schematic diagram of a compression release retarder incorporating an improved control valve in accordance with the present invention. As noted above, the basic design of the compression release retarder is disclosed in the Cummins U.S. Pat. No. 3,220,392. For purposes of simplicity and clarity, the present invention will be described with reference to an engine retarder applied to a Cummins compression ignition engine in which the master piston of the retarder is driven by the fuel injector pushtube. It will be understood that the invention may also be applied to other engines where, for example, the master piston is driven by an exhaust or intake valve pushtube. The invention is applicable to engines employing single or dual exhaust valves.

Referring now to FIG. 1A, the numeral 10 designates a housing for the retarder mechanism which is fastened to the cylinder head 12 of the internal combustion engine. Typically, there will be a housing 10 for two or three cylinders of an engine. Oil from the engine sump 14 or other hydraulic fluid supply source is pumped through a duct 16 by a low pressure pump 18 to the inlet 20 of a solenoid valve 22 mounted in the housing 10. Low pressure oil is conducted from the solenoid valve 22 to the inlet 24 of the control valve 26 by a delivery duct 28. The solenoid valve 22 also communicates through a drain duct 30 with the sump 14. The solenoid valve 22 is a three-way valve having a valve element 32 biased by a compression spring 34 to a position whereby the delivery duct 28 communicates with the drain duct 30. However, when the solenoid 36 is energized, the valve element 32 is driven downwardly (as shown in FIG. 1A) against the bias of spring 34 so that the oil supply duct 16 communicates with the delivery duct 28.

The improved control valve 26 is also positioned in the retarder housing 10 and comprises a check valve chamber 38 closed at one end by a plug 40 and having a check valve seat 42 formed in the opposite end of the check valve chamber 38 adjacent to the control valve bore 44. The control valve bore 44 communicates with the control valve inlet 24, duct 28 and also with an enlarged chamber 46. A control valve 48 having a head section 50 and a shaft section 52 is positioned so that the head section 50 reciprocates within the chamber 46 while the shaft section 52 is located within the bore 44. A check valve 54 is located within the check valve chamber 38 and biased toward the valve seat 42 by a compression spring 56 seated against the plug 40.

The chamber 46 is closed by a hat-shaped cap 58 which is held in place by a snap ring 60. Snap ring 60 seats in an annular groove 62 formed in the housing 10. A preferably preloaded compression spring 64 acting between the cap 58 and the control valve 48 biases the control valve in a downward direction as shown in FIG. 1A.

An anti-jacking sleeve 66 is positioned in the bore forming chamber 46 above the control valve head 50 and biased in a downward direction (as shown in FIG. 1A) by a compression spring 68 which also, preferably, is preloaded. A pressure relief duct 70 communicates between the upper end of the chamber 46 and the sump 14.

Under normal operating conditions, the control valve is moveable between a first position where the head section 50 of the control valve 48 rests against the anti-jacking sleeve 66, but does not lift the sleeve 66, and a second position where the shaft section 52 moves the check valve 54 away from its seat 42 against the bias of compression spring 56. Depending upon the design of the check valve 54, which may be conical or cylindrical and which may extend partially into the control valve bore 44, the shaft section 52 of the control valve 48 may be wholly within the control valve bore 44 or extend partially into the check valve chamber 38 when the control valve 48 is in its second position and has opened the check valve 54.

Under unusual conditions involving excessively high engine oil pressure, the control valve 48 is moveable to a third position in which the control valve head 50 rises above the opening of the relief duct 70 against the combined bias of springs 64 and 68 so as to vent the excess high pressure engine oil.

An outlet duct 72 communicates between the check valve chamber 38 and the slave cylinder 74 while duct 76 communicates between the slave cylinder 74 and the master cylinder 78. A slave piston 80 is mounted for reciprocating motion within the slave cylinder 74 and biased in an upward direction (as shown in FIG. 1A) by a compression spring 82. In its rest position, the upper end of the slave piston 80 abuts against an adjusting screw 84 threaded into the retarder housing 10 and locked in its adjusted position by a locknut 86. If the engine is fitted with dual exhaust valves, as shown in FIG. 1A, the slave piston 80 acts against a crosshead 88 mounted for reciprocating motion on a pin 90 pressed into the engine head 12. The crosshead 88, in turn, acts against the stems 92 of exhaust valves 94 which are biased toward the closed position by valve springs 96. A fragment of the rocker arm 98 which normally opens the exhaust valves 94 during the normal exhaust stroke of the engine is shown in contact with the crosshead 88.

A master piston 100 is mounted for reciprocating motion within the master cylinder 78 and is biased in an upward direction by a light leaf spring 102 fastened to the retarder housing 10 by a screw 104. The master piston 100 is driven by the fuel injector pushtube 106 through the adjusting screw mechanism 108 of the fuel injector rocker arm 110. It will be appreciated by those skilled in the art that when a fuel injector pushtube is selected to drive the master piston, the fuel injector pushtube will be associated with the same cylinder as the exhaust valves 94. However, if an exhaust or intake valve pushtube is selected to drive the master piston, then that pushtube will be associated with a cylinder other than the cylinder associated with the exhaust valves 94. It will be appreciated than any pushtube may be selected to drive the master piston 100 which moves upward (as shown in FIG. 1A) during the compression stroke of the cylinder with which exhaust valves 94 are associated.

The electrical control system for the engine retarder comprises the vehicle battery 112 which is grounded at 114 and the following elements connected in series: fuse 116, manual cut-off switch 122, clutch switch 118, fuel cut-off switch 120, solenoid 36 and ground 114. A diode 126 may also be connected between the switches and the ground to prevent arcing of the switches. The manual cut-off switch 122 enables the operator to shut off the retarder if he wishes to do so. The clutch switch 118 automatically shuts off the retarder whenever the engine clutch is depressed so as to prevent stalling of the engine. The fuel cut-off switch 120 shuts off or reduces the flow of fuel to the fuel injectors whenever the retarder is operated so as to minimize back-firing of the engine during the retarding mode of operation. It will be appreciated that one solenoid valve may be associated with two or more cylinders, if desired.

As noted above, FIG. 1A illustrates a condition in which the retarder is turned off and duct 28 communicates through the solenoid valve 22 to the drain duct 30. In this circumstance, compression spring 64 biases the control valve 48 downwardly so as to open the check valve 54 against the bias of compression spring 56 and, thus, permit oil to flow from the check valve chamber 38, the slave cylinder 74 and the master cylinder 78. Once the hydraulic pressure has been reduced, the slave piston 80 will be moved into abutment with the adjusting screw 84 by the spring 82 and the master piston will be moved upwardly by the bias of spring 102 so that the retarder mechanism will be entirely disassociated with the engine components.

Figure 1B:
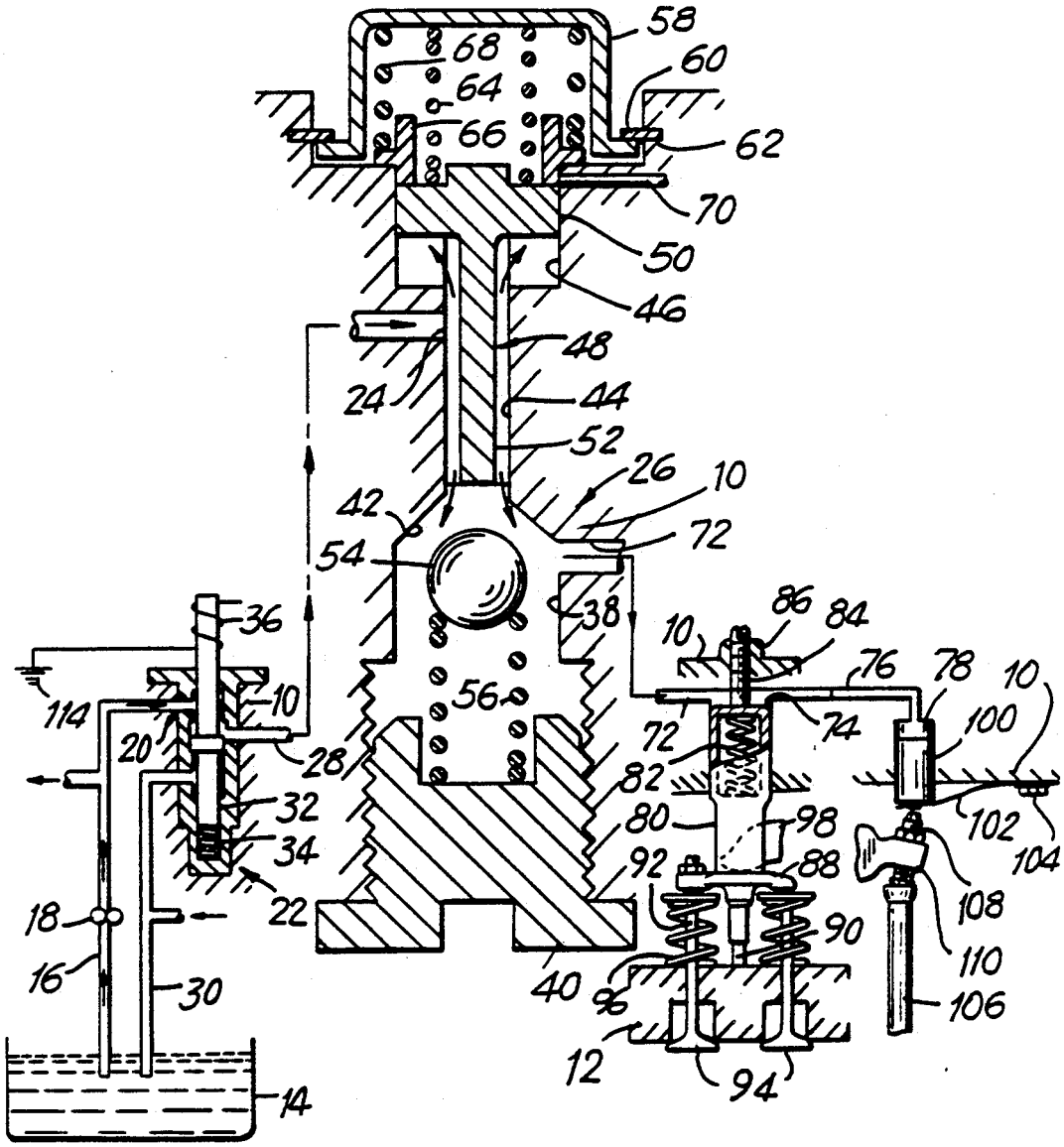

Turning now to FIG. 1B which shows the position of the parts when the retarder has been turned on, the solenoid valve element 32 will be driven downwardly (as shown in FIG. 1B) so that low pressure oil flows through the solenoid valve 22 and into the bore 44 and control valve chamber 46, thereby lifting the control valve 48 until it seats against the anti-jacking sleeve 66. When the control valve 48 is raised, the check valve 54 is biased against seat 42. However, since the spring force of compression spring 56 is relatively low, the low pressure oil will pass the check valve 54 to fill the check valve chamber 38, the slave cylinder 74 and the master cylinder 78. The pressure of the low pressure oil is sufficient to move the master piston 100 downward so as to contact the adjusting screw mechanism 108. The spring force of spring 68 is chosen to be sufficiently great so that with normal engine oil pressure the control valve 48 will not lift the anti-jacking sleeve 66 so as to cause the head 50 of the control valve 48 to expose the drain duct 70. However, if for any reason the oil supply pressure should become excessive, the control valve 48 will rise until the control valve head 50 uncovers the entry to the drain duct 70, whereby excess oil will be drained from the retarder.

Figure 1C:
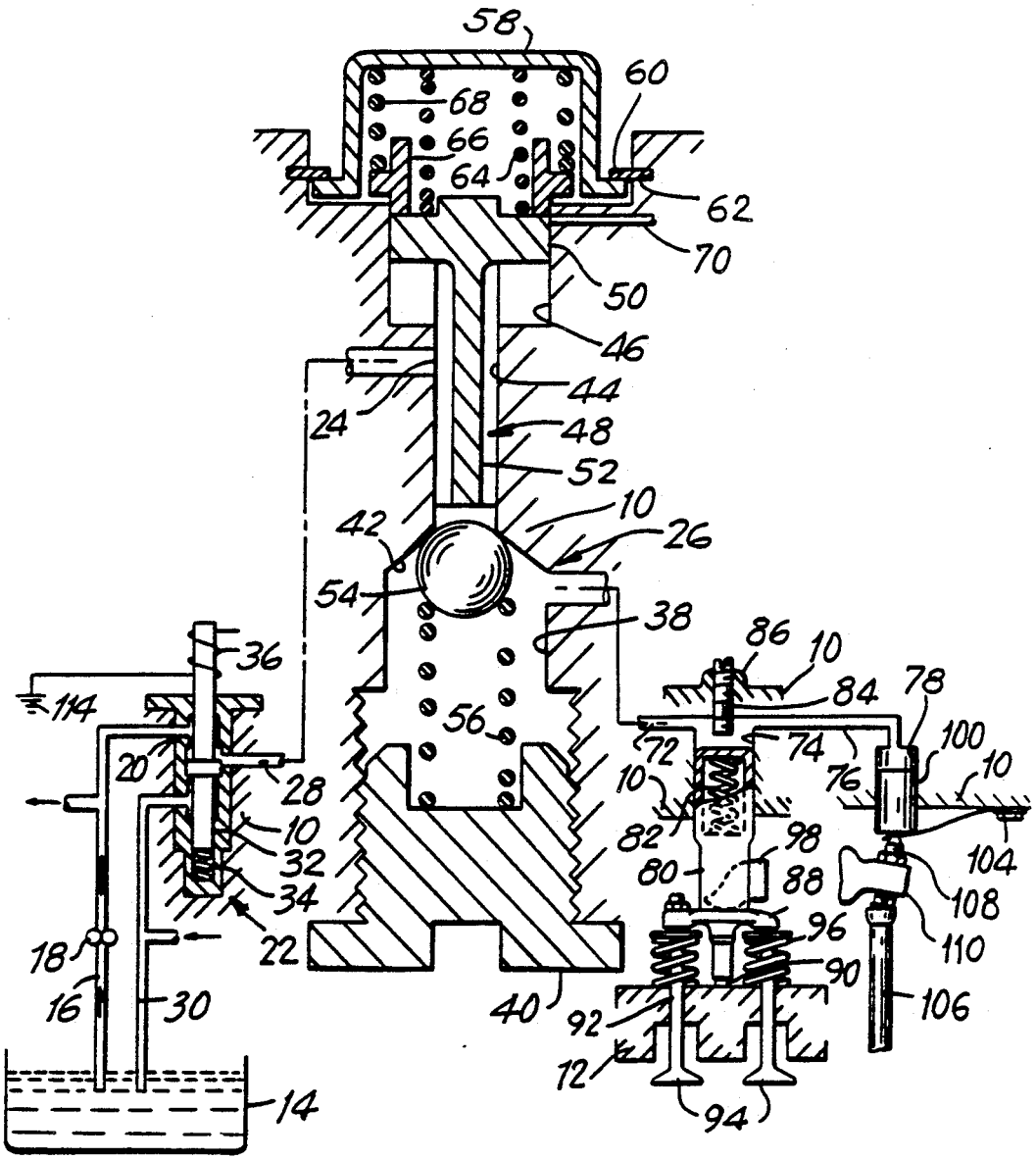
FIG. 1C is a schematic diagram of the apparatus of FIG. 1A showing the position of the parts during the retarding cycle when the exhaust valves have been opened.

Reference is now made to FIG. 1C which shows the operation of the mechanism during a retarding event. Once the master piston 100 begins to move upwardly, the pressure in the hydraulic circuit comprising the master cylinder 78, the slave cylinder 74, the check valve chamber 38 and the interconnecting ducts 72 and 76 rises rapidly and the check valve 54 is tightly seated against the check valve seat 42. It will be appreciated that while there is a large pressure drop across the check valve 54, which is part of the high pressure circuit containing the master piston 100 and the slave piston 80, the pressure drop across the control valve 48 is approximately the pressure produced by the low pressure oil supply. For this reason neither the control valve 48 nor the chamber 46 requires a close tolerance and, thus, expensive machining operations are obviated. Particularly if the check valve 54 is a ball valve, it is possible to provide a tight seal without encountering production difficulties.

It will be appreciated that as the master piston 100 moves in response to the motion of the pushtube 106, the slave piston 80 will follow and open the exhaust valves near the end of the compression stroke of the engine. When the master piston is retracted during the intake stroke, following the motion of the fuel injector pushtube, the pressure in the hydraulic circuit will drop to a low pressure and permit additional oil to flow past the check valve 54 to replace leakage. Thus the cycle will repeat during each engine cycle until the retarder is turned off.

Figure 1D:
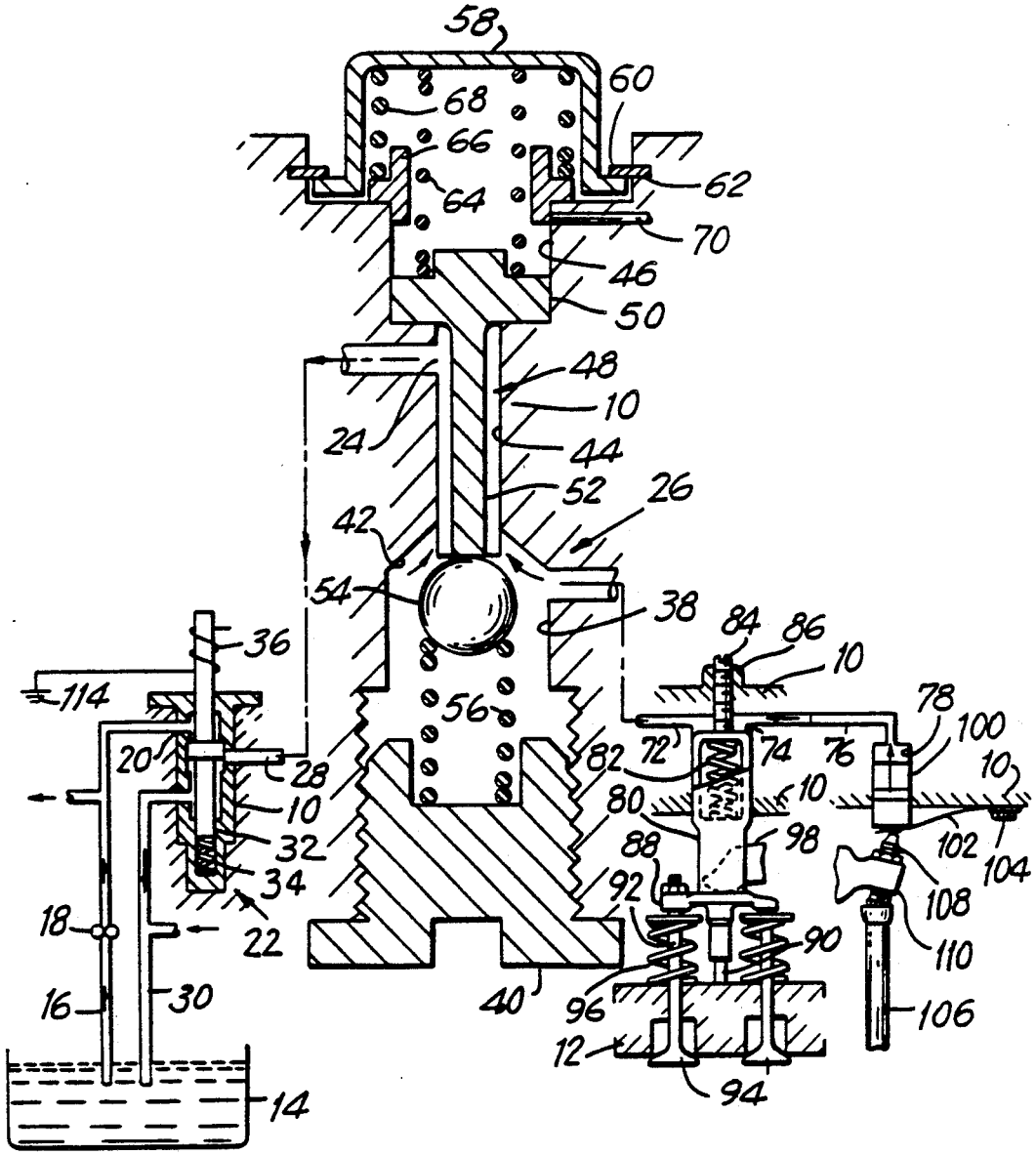
FIG. 1D is a schematic diagram of the apparatus of FIG. 1A showing the position of the parts shortly after the retarder has been turned off.

As soon as the retarder is turned off, the parts will assume the positions shown in FIG. 1D. First, as the solenoid valve 22 begins to drain, the control valve 48 moves downward to contact the check valve 54. When, due to the return movement of the master piston 100 the pressure in the hydraulic system drops, the slave piston 80 will return to its rest position and the check valve 54 will open. Finally, the leaf spring 102 will disengage the master piston 100 from the adjusting screw mechanism 108 and the retarder mechanism will be at rest. It will be understood that at no time in the operating cycle of the retarder is a large pressure drop developed across the control valve 48. Thus, the control valve 48 has effectively been removed from the high pressure circuit.

As pointed out in U.S. Pat. No. 4,473,047, it is advantageous to open only one of the dual exhaust valves of an engine during retarding. However, it is important when opening a single valve to ensure that it has been closed prior to the normal opening of both valves during the exhaust stroke so that undue stresses are not imposed on the valve train mechanism. An hydraulic reset mechanism is disclosed in U.S. Pat. No. 4,399,787 which accomplishes this purpose. FIGS. 2A–2F illustrate the operation of the present invention in conjunction with an engine having a retarder which opens only one of the dual exhaust valves and which incorporates an hydraulic reset mechanism. For simplicity of description only one of the dual exhaust valves is shown. Of course, the present invention is applicable to engines having only one exhaust valve per cylinder and such engines may also use the hydraulic reset mechanism to ensure that impact loading of the exhaust valve stem does not occur. In connection with the following description, parts which are common to FIGS. 1 and 2 will bear the same designation and the description will not be repeated. It will be understood that the electrical control system described above is equally applicable to the mechanism shown in FIGS. 2A–2F.

Figure 2A:
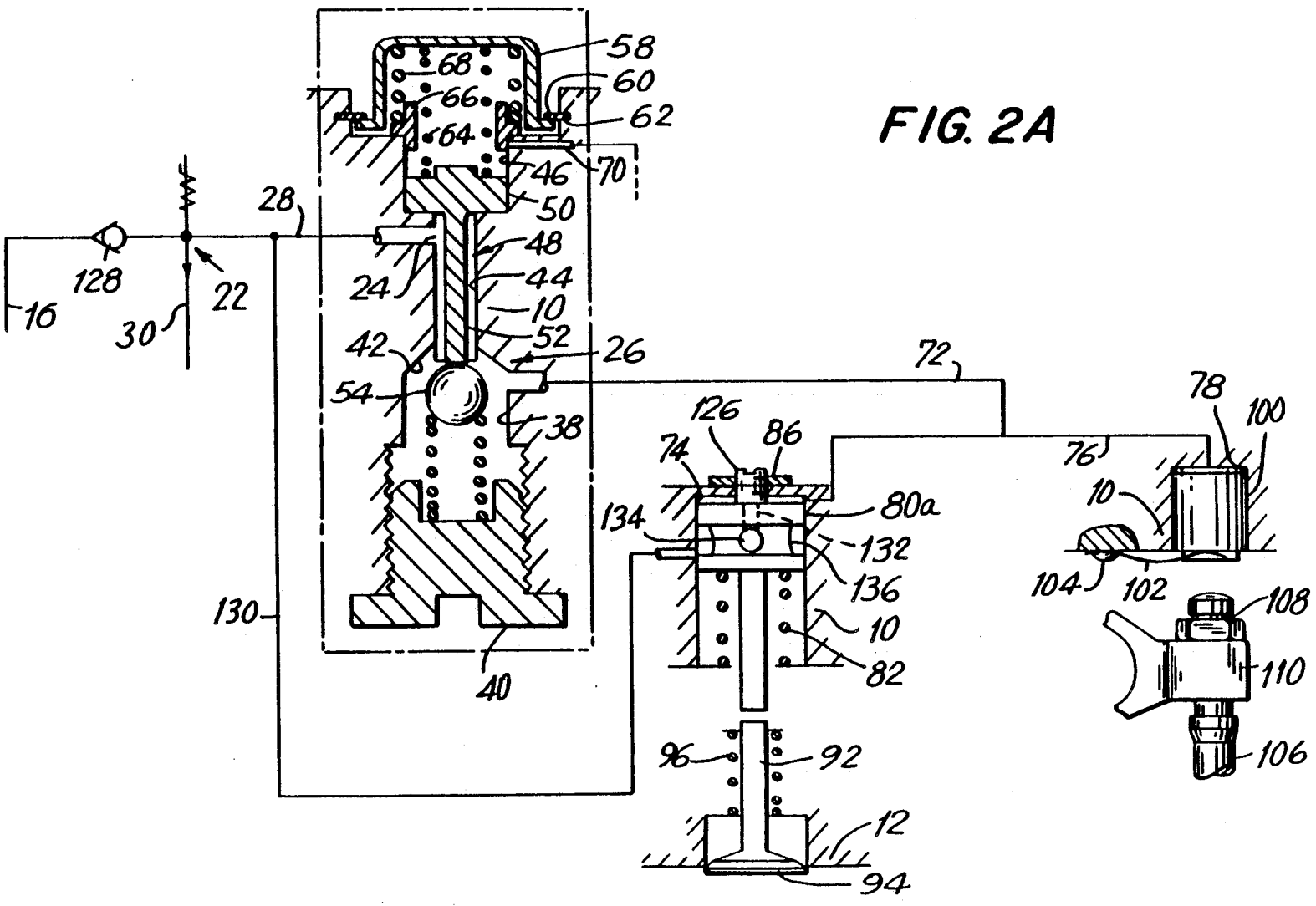
FIG. 2A is a schematic diagram of a compression release engine retarder incorporating the improved control valve in accordance with the present invention in an engine where only one of the dual exhaust valves is opened, showing the position of the parts when the retarder is turned off.

Reference is now made to FIG. 2A which shows the position of the retarder parts when the retarder is turned off. The solenoid valve 22, the control valve 26 and the master piston and injector drive are identical with the corresponding parts shown in FIG. 1A. However, due to the addition of the hydraulic reset mechanism 126, the slave piston **80*a*** is modified, a check valve 128 is required between the solenoid valve 22 and the low pressure oil pump, and an oil return line 130 is required between the low pressure side of the slave piston 80*a* and inlet 24 to the control valve 26.

As disclosed in detail in U.S. Pat. No. 4,399,787, which is incorporated by reference herein, the slave piston 80*a* contains an axial passageway 132 which communicates with a diametral passageway 134 which, in turn, communicates with a circumferential groove 136 in the slave piston. The circumferential groove 136 is in registry with duct 130 when the slave piston 80*a* has opened the exhaust valve 94 and reached a predetermined point in its travel. Until the slave piston 80*a* attains the predetermined travel, the reset mechanism (as described in U.S. Pat. No. 4,399,787) seals passageway 132 so as to prevent the flow of oil therethrough. Once the determined point of travel is reached and the pressure in the hydraulic circuit drops, the hydraulic reset mechanism 126 opens passageway 132 and intermediate pressure oil flows through passageway 130 and is stored in chamber 46 under the head 50 of control valve 48.

Referring now to FIG. 2A, the retarder is shown in the "off" position in which oil has drained from the master cylinder 78, the slave cylinder 74 and the chamber 46 below the head 50 of the control valve 48. Both the slave piston 80*a* and the master piston 100 are disengaged from the operating parts of the engine.

Figure 2B:
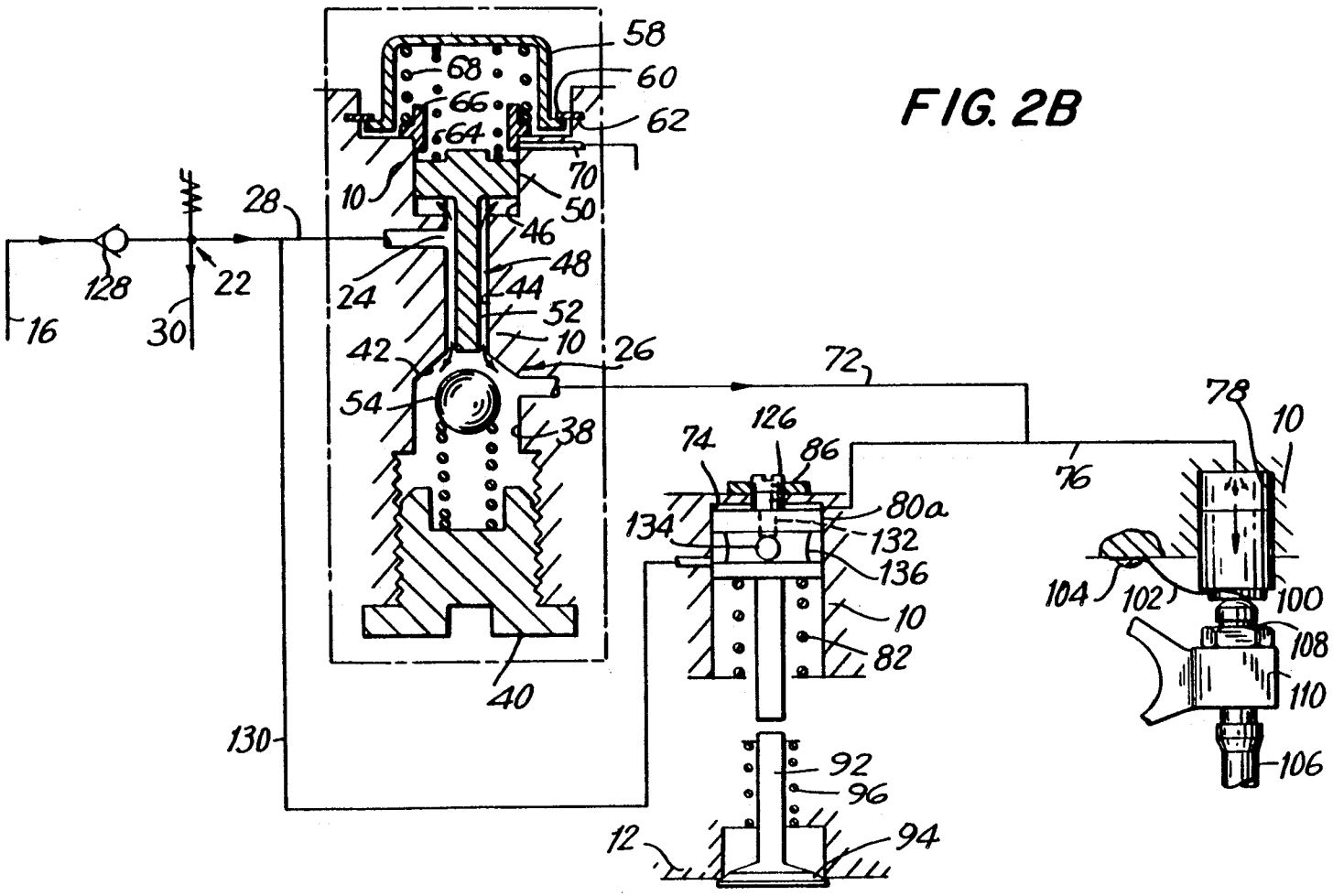

FIG. 2B shows the position of the retarder components just after the retarder is turned on. Oil flows through duct 16, the check valve 128 and the solenoid valve 22 into the control valve bore 44 and begins to lift the control valve 48. At the same time, oil flows past check valve 54 to fill the check valve chamber 38, the slave cylinder 74, the master cylinder 78 and the interconnecting ducts 72 and 76. The low pressure oil moves the master piston 100 downwardly against the bias of the light leaf spring 102 until the master piston 100 contacts the adjusting screw mechanism 108 associated with the fuel injector pushtube 106 and rocker arm 110.

Figures 2C, 3:
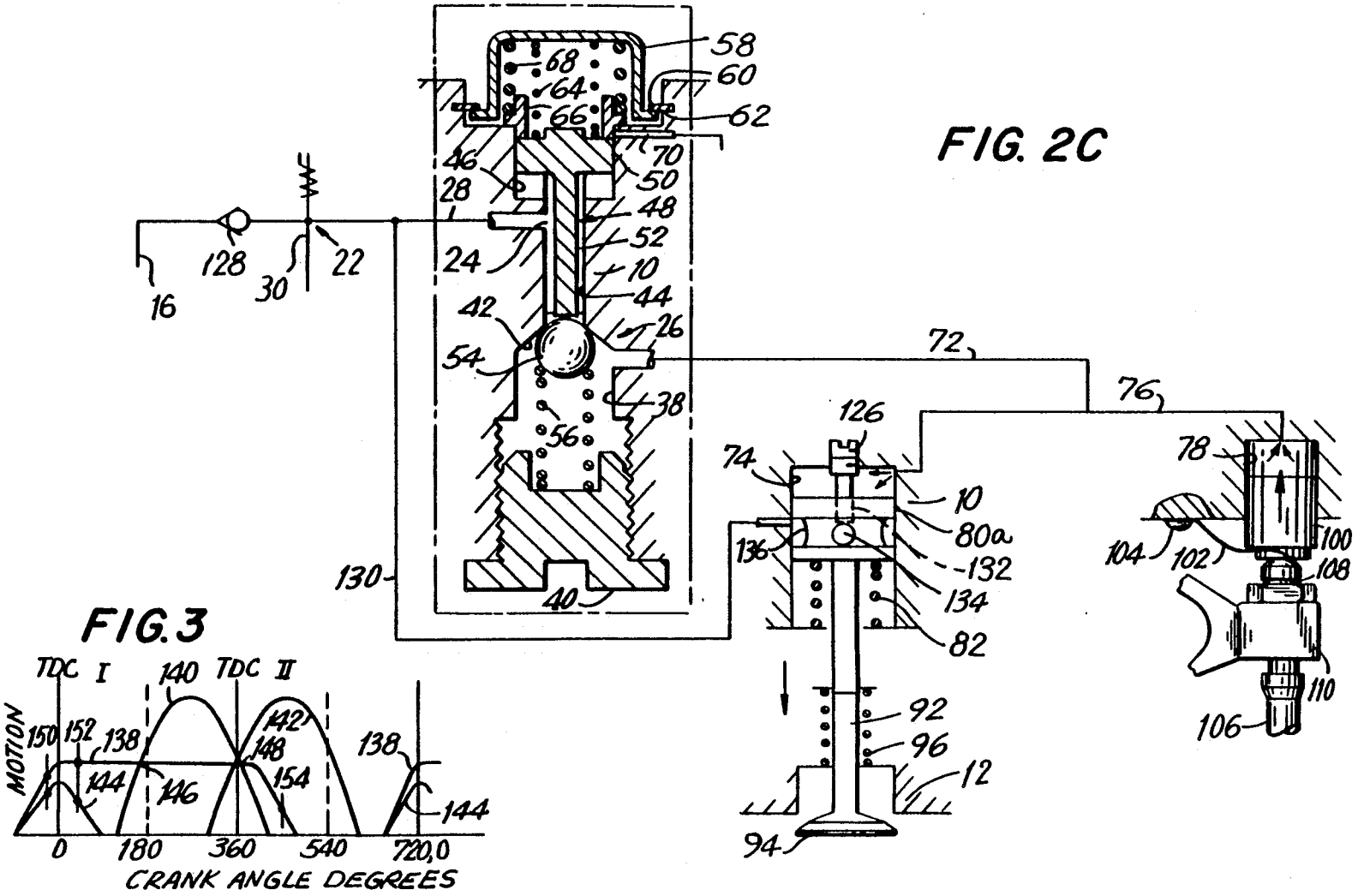
FIG. 2C is a schematic diagram of the apparatus of FIG. 2A showing the position of the parts during the retarding cycle when one exhaust valve has been opened.
FIG. 3 is a diagram showing the motion of the fuel injector, exhaust valves and intake valves during a retarding cycle and indicating the point in the retarding cycle represented by each of FIGS. 2C through 2F.

Before proceeding further, reference will be made to FIG. 3 which illustrates the motion of the fuel injector pushtube, exhaust valve and intake valve during an engine cycle of two revolutions or 720 crankangle degrees. Curve 138 represents the motion of the fuel injector pushtube 106 which begins during the compression stroke of the engine piston prior to the top dead center I position (TDC I) of the engine piston. The fuel injector remains seated during the "power" or "expansion" stroke of the engine (0° to 180°) and also during the exhaust stroke of the engine (180° to 360°). During the intake stroke of the engine (360° to 540°) the injector retracts but during the compression stroke of the engine (540° to 720°) the injector begins to move again. Curve 140 represents the normal or "powering" motion of the exhaust valve 94 which begins to open near the end of the power stroke, remains open during the exhaust stroke and closes at the beginning of the intake stroke. Curve 142 represents the normal or "powering" motion of the intake valve (not shown) which begins to open near the end of the exhaust stroke, remains open during the intake stroke and closes at the beginning of the compression stroke. Curve 144 represents the additional opening of the exhaust valve near the TDC I position which constitutes the compression release event wherein the energy stored in the engine cylinder during the compression stroke of the engine is not recovered but, instead, is dissipated in the form of heat and pressure loss in the engine cooling and exhaust systems.

It will be appreciated that in the form of the invention shown in FIGS. 1A–1D the exhaust valve 94 will open substantially following curve 138, since it is driven from the injector pushtube 106, until it reaches point 146 and then will follow the normal exhaust curve 140 until it reaches point 148 where it will again follow the injector curve 138. The abrupt change of motion at points 146 and 148 causes a stress loading of the exhaust valve train mechanism which may be undesirable. It is for this reason, in part, that the hydraulic reset mechanism 126 disclosed in U.S. Pat. No. 4,399,787 is employed. This mechanism causes the exhaust valve 94, the motion of which is triggered by the movement of the injector pushtube 106, to close shortly after the compression release event occurs at TDC I as shown by curve 144. Since the exhaust valve is closed following the compression release event before the normal opening of the exhaust valve occurs, no abnormal stresses or other adverse conditions are produced.

Returning now to FIG. 2C, this Figure illustrates the position of the retarder parts after the exhaust valve has been opened and the compression release event is in progress. On FIG. 3 this point is shown by the designation 150. The upward motion of the master piston 100 has caused the pressure to rise in the master cylinder 78, slave cylinder 76 and check valve chamber 38 so as to seal the check valve 54 against its seat 42 and drive the slave piston 80*a* downwardly (as shown in FIG. 2C) to open the exhaust valve 94.

Figure 2D:
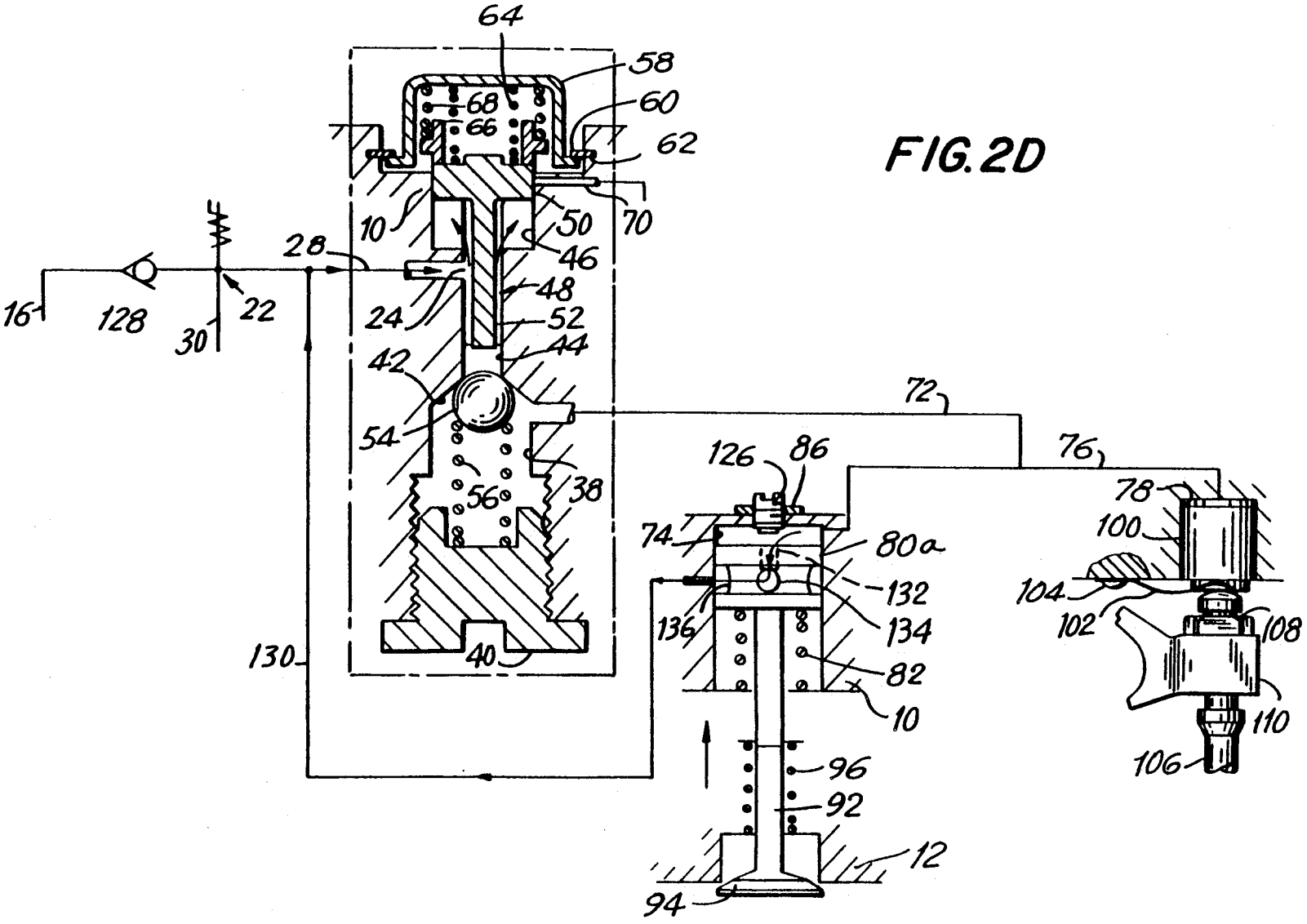
FIG. 2D is a schematic diagram of the apparatus of FIG. 2A showing the position of the parts immediately after the compression release event when the hydraulic reset mechanism has been activated to store oil in the control valve.

FIG. 2D illustrates the position of the retarder parts just after the hydraulic reset mechanism has opened to release the hydraulic fluid within the system. On FIG. 3 this point is shown by the designator 152. At this point, the master piston 100 has reached its maximum travel, the slave piston 80*a* has retracted somewhat due to the decrease in the cylinder pressure following the opening of the exhaust valve 94 and the reset mechanism 126 has opened to allow the flow of hydraulic fluid through passageways 132 and 134 and groove 136 of the slave piston 80*a* into the oil return line 130 and the control valve bore 44. The excess oil is stored in chamber 46 under the head 50 of the control valve 48.

Figure 2E:
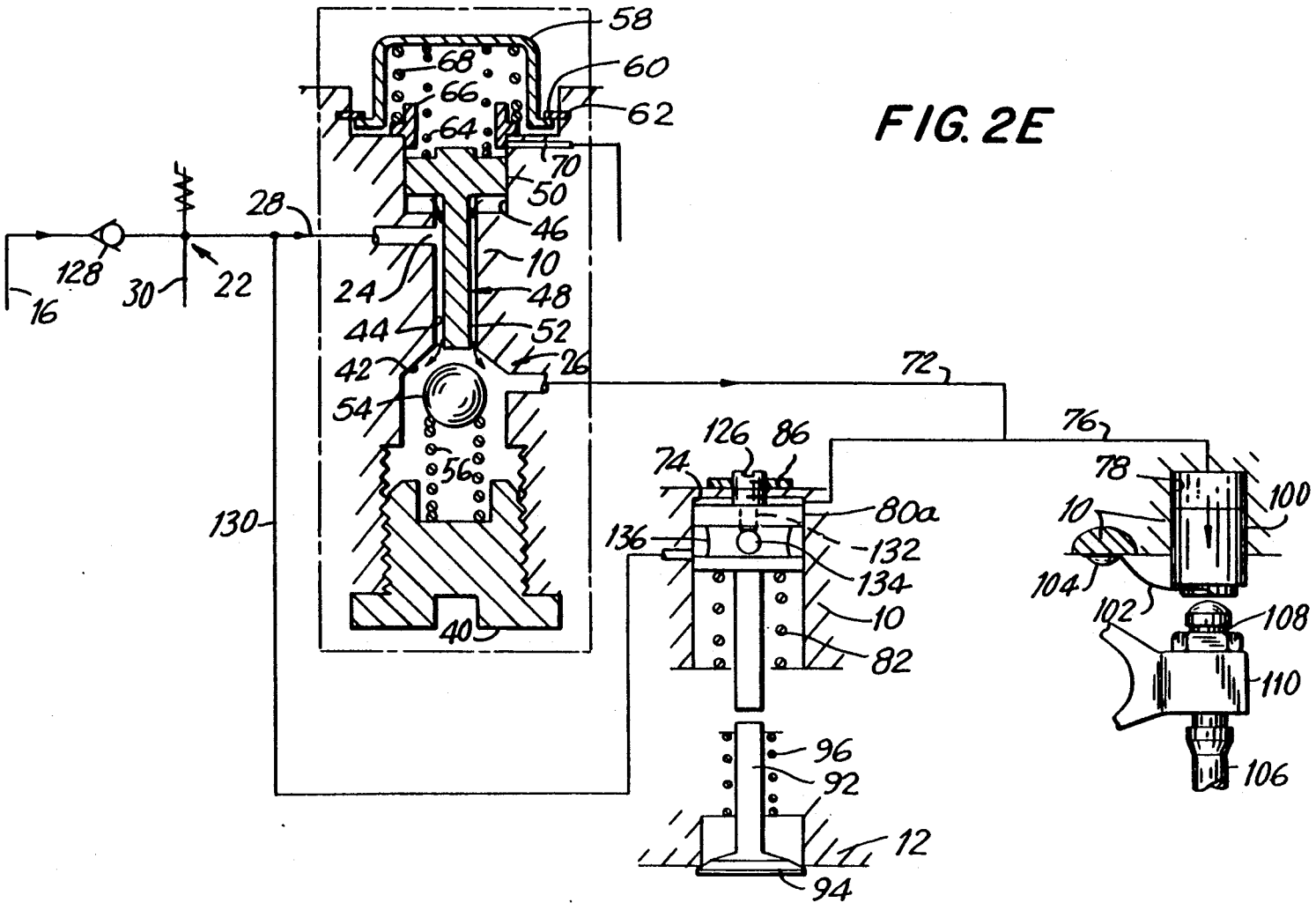
FIG. 2E is a schematic diagram of the apparatus of FIG. 2A showing the position of the parts at the end of the retarding cycle when stored oil is being returned to the high pressure hydraulic circuit.

FIG. 2E illustrates the position of the retarder parts near the end of the retarding cycle when the master piston 100 is moving downwardly (as shown in FIG. 2E) toward its rest position. On FIG. 3 this point is shown by the designator 154. Due to the flow of oil through duct 130, the slave piston 80*a* has retracted and the exhaust valve 94 has closed. The downward motion of the master piston causes the pressure in the check valve chamber 38 to drop so that the check valve 54 opens and the oil stored under the control valve 48 returns to fill the system, particularly the master cylinder 78. In the event of leakage, additional oil is supplied from the low pressure oil system through duct 16, check valve 128 and solenoid valve 22. The retarder is then ready to commence another retarding cycle.

Figures 2F, 2G:
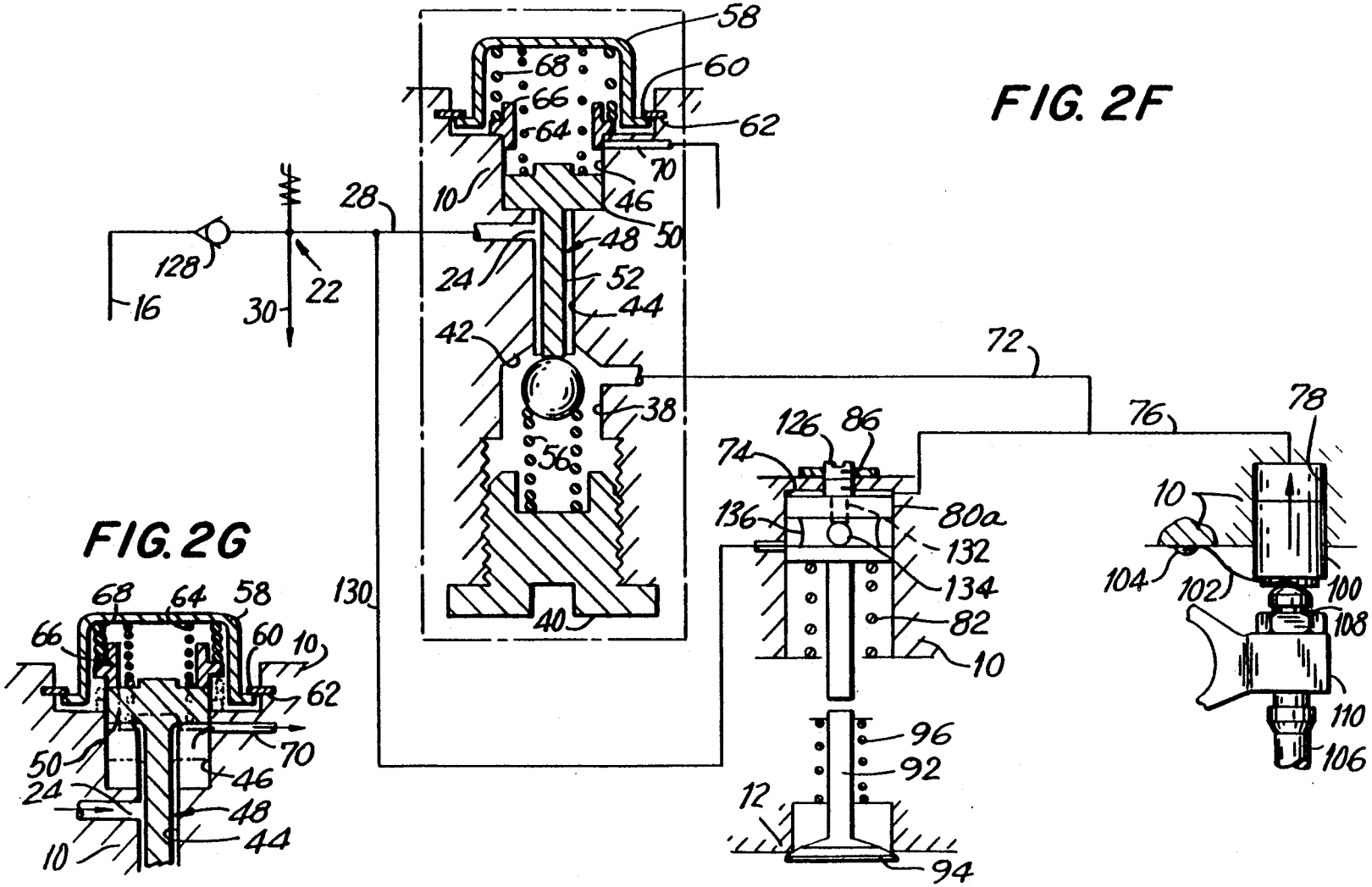
FIG. 2F is a schematic diagram of the apparatus of FIG. 2A showing the position of the parts shortly after the retarder has been turned off.
FIG. 2G is a fragmentary schematic drawing of the control valve showing the operation of the anti-jacking feature.

FIG. 2F shows the position of the retarder parts shortly after the retarder has been turned off. As noted above, the solenoid valve 22 closes so as to connect the control valve bore 44 with the solenoid drain duct 30. As oil drains from the system, the control valve 48 opens the check valve 54 and the slave piston 80*a* will be brought to its rest position by its return spring 82. Similarly, the master piston 100 will return to its rest position under the bias of the leaf spring 102. Of course, depending upon the point in the engine cycle when the retarder is turned off the master piston 100 may be driven part way to its rest position by the injector pushtube 106.

FIG. 2G is a fragmentary view of the upper end of the control valve 48 and illustrating the anti-jacking feature of the present invention. With reference to FIG. 3 it will be appreciated that the normal maximum opening of the exhaust and intake valves occurs when the engine piston is considerably displaced from the top dead center position (either TDC I or TDC II). However, since the compression release event occurs close to TDC I, it is important to ensure that the exhaust valve is opened no more than may be required so that there is no risk of the engine piston striking the opened exhaust valve. It will be appreciated that if the engine oil supply pressure should become excessive, the quantity of oil in the high pressure system could cause the slave piston to be "jacked" beyond its normal position thereby causing excessive opening of the exhaust valve. This condition is obviated in accordance with a feature of the present invention. It will be understood that the pressure produced by the engine oil system is sensed by the control valve 48 which moves upwardly in the chamber 46 against the bias of spring 64. As the pressure in the chamber 46 below the head 50 of the control valve 48 increases, the head 50 will contact the anti-jacking sleeve 66 and lift it against the additional bias of spring 68. At a predetermined pressure level, the head 50 of the control valve 48 will expose the opening of duct 70 whereupon oil will flow back to the sump 14 to release the excess oil and thereby prevent "jacking" of the slave piston 80 or 80*a*.

It will now be appreciated that whenever the pressure in the retarder hydraulic circuit is substantially above the pressure of the engine oil supply, the control valve is not exposed to such high pressure. For this reason, the control valve need not be a precision part and is not subject to close machining tolerances. As noted above, the control valve of the present invention may be used with engines having dual exhaust valves and retarders which open both valves as well as retarders which open only one of the dual exhaust valves. Of course, the control valve of the present invention may be employed with retarders for engines having only a single exhaust valve for each cylinder. Finally, the control valve of the present invention provides temporary storage of oil used to perform the retarding function and thereby limits the quantity of oil required from the engine oil supply system and, at the same time, prevents "jacking" of the slave piston and exhaust valves.

The terms and expressions which have been employed are used as terms of description and not of limitation and there is no intention in the use of such terms and expressions of excluding any equivalents of the features shown and described or portions thereof, but it is recognized that various modifications are possible within the scope of the invention claimed.

What is claimed is:

1. In an engine retarding system of a gas compression release type including an internal combustion engine having exhaust valve means and pushtube means, hydraulic fluid supply means, retarder housing means affixed to said internal combustion engine, hydraulically actuated first piston means having high and low pressure sides located in said retarding housing means and associated with said exhaust valve means and said hydraulic fluid supply means to open said exhaust valve means at a predetermined time and moveable between first and second positions, second piston means located in said retarder housing means and actuated by said pushtube means, and hydraulically interconnected with said first piston means, and adjustable stop means located in said retarder housing means and disposed in abutment with said first piston means when said first piston means is in said first position, the improvement comprising an hydraulic control valve mechanism located in said retarder housing means between said hydraulic fluid supply means and said first and second piston means, said hydraulic control valve mechanism comprising a low pressure chamber communicating with said hydraulic fluid supply means, a check valve chamber communicating with said low pressure chamber, said check valve chamber having an outlet which communicates with said first and second piston means, a check valve located in said check valve chamber to permit flow of hydraulic fluid from said low pressure chamber to said check valve chamber, a control valve having a head section and a shaft section, said head section slidably mounted in said low pressure chamber between a first position in which said shaft section is displaced from said check valve and a second position in which said shaft section opens said check valve and first biasing means biasing said control valve toward said second position.

2. An engine retarding system as set forth in claim 1 wherein said check valve is a ball valve.

3. An engine retarding system as set forth in claim 1 and comprising, in addition a sleeve member mounted coaxially with said control valve and on the side of said control valve head section opposite said shaft section, second biasing means biasing said sleeve member toward said head section of said control valve and a drain duct communicating with said low pressure chamber.

4. An engine retarding system as set forth in claim 3 and comprising, in addition, a cap affixed to said retarder housing means substantially coaxially with said control valve, said cap adapted to provide a seat for said first and said second biasing means.

5. In an engine retarding system of a gas compression release type including an internal combustion engine having exhaust valve means and pushtube means, hydraulic fluid supply means, retarder housing means affixed to said internal combustion engine, hydraulically actuated first piston means having high and low pressure sides located in said retarder housing means and associated with said exhaust valve means and said hydraulic fluid supply means to open said exhaust valve means at a predetermined time and moveable between first and second positions, second piston means located in said retarder housing means and actuated by said pushtube means and hydraulically interconnected with said first piston means, and hydraulic reset mechanism means disposed in abutment with said first piston means when said first piston means is in said first position and operable in response to the opening of said exhaust valve means at said predetermined time to permit said first piston means to return from said second position to said first position to close said exhaust valve means, the improvement comprising an hydraulic control valve mechanism located in said retarder housing means between said hydraulic fluid supply means and said first and second piston means, said hydraulic control valve mechanism comprising a low pressure chamber communicating with said hydraulic fluid supply means, a check valve chamber communicating with said low pressure chamber, said check valve chamber having an outlet which communicates with said first and second piston means, a check valve located in said check valve chamber to permit flow of hydraulic fluid from said low pressure chamber to said check valve chamber, a control valve having a head section and a shaft section, said head section slidably mounted in said low pressure chamber between a first position in which said shaft section is displaced from said check valve and a second position in which said shaft section opens said check valve, and first biasing means biasing said control valve toward said second position.

6. An engine retarding system as set forth in claim 5 wherein said check valve is a ball valve.

7. An engine retarding system as set forth in claim 5 and comprising, in addition, a sleeve member mounted coaxially with said control valve and on the side of said control valve head section opposite said shaft section, second biasing means biasing said sleeve member toward said head section of said control valve and a drain duct communicating with said low pressure chamber.

8. An engine retarding system as set forth in claim 7 and comprising, in addition, a cap affixed to said retarder housing means substantially coaxially with said control valve, said cap adapted to provide a seat for said first and said second biasing means.

* * * * *